US006841037B2

(12) United States Patent
Scherb et al.

(10) Patent No.: US 6,841,037 B2
(45) Date of Patent: Jan. 11, 2005

(54) MACHINE AND PROCESS FOR PRODUCING A TISSUE WEB

(75) Inventors: Thomas Thoröe Scherb, Sao Paulo (BR); Harald Schmidt-Hebbel, Barueri (BR)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 09/769,464

(22) Filed: Jan. 26, 2001

(65) Prior Publication Data

US 2001/0010260 A1 Aug. 2, 2001

(30) Foreign Application Priority Data

Jan. 28, 2000 (DE) ..... 100 03 684

(51) Int. Cl.[7] ..... D21F 1/10; D21F 11/00

(52) U.S. Cl. ..... 162/109; 162/116; 162/199; 162/203; 162/274; 162/296; 162/300; 162/301; 162/903; 139/383 A; 139/425 A

(58) Field of Search ..... 162/100, 109–117, 162/199, 203, 217, 274–279, 272, 351, 300, 301, 296, 348, 903, 363, 367, 368; 139/383 A, 425 A

(56) References Cited

U.S. PATENT DOCUMENTS

| | | | | |
|---|---|---|---|---|
| 3,322,617 A | | 5/1967 | Osborne | 162/296 |
| 4,144,124 A | * | 3/1979 | Turunen et al. | 162/301 |
| 4,759,391 A | * | 7/1988 | Waldvogel et al. | 139/383 A |
| 4,967,805 A | * | 11/1990 | Chiu et al. | 139/383 A |
| 5,211,815 A | * | 5/1993 | Ramasubramanian et al. | 162/348 |
| 5,225,042 A | * | 7/1993 | Eaton et al. | 162/301 |
| 5,393,384 A | | 2/1995 | Steiner et al. | 162/359.1 |
| 5,492,598 A | | 2/1996 | Hermans et al. | 162/113 |
| 5,517,714 A | | 5/1996 | Kotitschke | 162/275 |
| 5,527,428 A | | 6/1996 | Trokhan et al. | 162/116 |
| 5,534,326 A | | 7/1996 | Trokhan et al. | 428/131 |
| 5,654,076 A | | 8/1997 | Trokhan et al. | 428/131 |
| 5,746,887 A | | 5/1998 | Wendt et al. | 162/109 |
| 6,004,429 A | | 12/1999 | Schiel | 167/111 |
| 6,136,146 A | | 10/2000 | Phan et al. | 162/109 |
| 6,203,663 B1 | | 3/2001 | Kamps et al. | 162/109 |
| 6,237,644 B1 | * | 5/2001 | Hay et al. | 139/383 A |
| 6,554,959 B2 | * | 4/2003 | Von Paleske et al. | 162/109 |

FOREIGN PATENT DOCUMENTS

| | | | | |
|---|---|---|---|---|
| DE | 4224730 | | 9/1993 | |
| DE | 4327601 | | 1/1995 | |
| DE | 19654198 | | 6/1998 | |
| DE | 19732879 | | 2/1999 | |
| SE | 427053 | | 2/1983 | |
| SE | 427 053 | * | 2/1983 | D21F/1/10 |
| WO | 94/28242 | * | 12/1994 | |
| WO | 96/35018 | | 11/1996 | |
| WO | 99/06629 | | 2/1999 | |
| WO | 00/12817 | | 3/2000 | |

OTHER PUBLICATIONS

Albany Int., "Paper Machine Felts and Fabrics" p. 14, 1976.*

* cited by examiner

*Primary Examiner*—Steven P. Griffin
*Assistant Examiner*—Eric Hug
(74) *Attorney, Agent, or Firm*—Greenblum & Bernstein, P.L.C.

(57) ABSTRACT

A machine for producing a tissue web is provided, including a former having a forming region which includes at least one circulating, continuous dewatering wire having zonally variable wire permeability. Furthermore, a process for producing the tissue web in a tissue machine is provided. The process includes forming the tissue web in a forming region of a former, wherein the forming region includes at least one circulating, continuous dewatering wire having zonally variable wire permeability.

30 Claims, 7 Drawing Sheets

MACHINE AND PROCESS FOR PRODUCING A TISSUE WEB

CROSS-REFERENCE TO RELATED APPLICATIONS

The present application claims priority under 35 U.S.C. § 119 of German Patent Application No. 100 03 684.8, filed on Jan. 28, 2000, the disclosure of which is expressly incorporated by reference herein in its entirety.

BACKGROUND OF THE INVENTION

1. Field of the Invention

The invention relates to a machine for producing a tissue web having a forming region that includes at least one circulating, continuous dewatering wire. It also relates to a process for producing a tissue web using a tissue machine having a forming region including at least one circulating, continuous dewatering wire.

2. Discussion of Background Information

Until now, the attempt has been made to influence the quality parameters of a tissue web, such as its water absorption capacity, water retention capacity, and water absorption speed, by means of the design of the surface structure of the tissue web. In the prior art (see for instance U.S. Pat. No. 5,746,887, U.S. Pat. No. 5,492,598, or SE 427 053), the use of so-called embossing wires or embossing felts is proposed. These elements impress their own surface structure on the tissue web that has already been formed. In this operation, the tissue web is subjected to pressure, which counteracts a desired high volume (bulk). At the same time, this process requires major expense for equipment, since the embossing wires can be used for this purpose only. Often, these methods are furthermore combined with special, expensive drying methods to increase the specific volume.

SUMMARY OF THE INVENTION

An aspect of the invention is to create both a process and a machine of the type defined at the outset, with which the design and structure, i.e., the disposition of the fibers in a tissue web, particularly at high machine speeds as well, can be designed in such a way that the water absorption capacity, water retention capacity, water absorption speed, and the specific volume (in bulk) can be enhanced or improved as economically as possible.

With regard to the tissue machine, this aspect is attained according to the invention in that in the forming region, at least one dewatering wire with zonally variable wire permeability is provided, i.e., a so-called DSP wire.

Based on this embodiment, it is attained that in the dewatering operation in the sheet forming zone, regions of high dewatering speed and regions of low dewatering speed are created. As a result, a tissue web with zonally variable fiber proportions is created with the water absorption of the tissue web being increased and also occurring faster. This affects the tissue web not only on the sheet surface but also over the entire volume of the sheet, thus considerably improving the quality parameters.

Wires with zonally variable wire permeability are especially known from SE 427 053. According to this reference, the applicable wires can (comprise, e.g.) a woven material, in which longitudinal and transverse threads provided in one or more levels are interwoven in accordance with a predeterminable pattern in such a way that it results in systematically distributed regions of suitable size, in which the number of intersection points is equal to zero, or is markedly less than in the woven structure of the remaining woven material.

In a particularly advantageous embodiment of the machine according to the invention, at least one dewatering wire with zonally variable wire permeability is provided in the initial dewatering region, in which the highest dewatering rates (in liters per minute) occur.

The advantageous effect is particularly operative at relatively high dewatering speeds, which become correspondingly higher as the machine speed increases. It is thus advantageous if the dewatering is performed at a machine speed that is greater than approximately 1300 m/min, in particular greater than approximately 1500 m/min, and preferably greater than approximately 1800 m/min.

A preferred practical embodiment of the machine according to the invention includes a former with two circulating, continuous dewatering belts, which converge, forming a stock inlet nip, and then are guided over a forming element, in particular such as a forming roll, and as an outer belt that does not come into contact with the forming element and/or as an inner belt, a dewatering wire with zonally variable wire permeability is provided.

In an expedient embodiment, as the former, a double wire former can be provided. As the outer belt and/or as the inner belt, a dewatering wire with zonally variable wire permeability, i.e., a so-called DSP wire, can be provided. If only one of the two belts is formed by such a DSP wire, then the other belt can be a conventional dewatering wire for tissue.

In an expedient alternative embodiment, as the former, a crescent former is provided, whose outer belt is formed by a dewatering wire with zonally variable wire permeability and whose inner belt is formed by a felt belt. The greatest dimension of the surface of the partial regions of the dewatering wire with zonally variable wire permeability is expediently $Az<5$ mm, preferably $Az<3$ mm.

It is also advantageous if the dewatering wire with zonally variable wire permeability is not needled with feltlike fibers but instead comprises a woven material formed of warp and weft threads, or in other words comprises only warp and weft threads.

The zones of variable wire permeability of the dewatering belt are advantageously generated by the use of weaving threads of variable diameter and/or variable weaving pattern. Advantageously, the dewatering wire with zonally variable wire permeability is used in a region in which the dry content of the tissue web is less than approximately 20% and in particular less than approximately 12%, and preferably in the initial sheet forming region at a dry content less than approximately 6%.

Since due to the variable permeability, fibers can penetrate the volume of the wire and adhere there, a conditioning device, in particular such as a wire cleaning device, is preferably assigned to the dewatering wire of zonally variable wire permeability. For instance, spray pipes with jets distributed over the machine width can be provided. However, a "Duocleaner" made by Voith Sulzer with rotating high-pressure jets and integrated vacuuming, or a "Jet Cleaner" made by Voith Sulzer can for instance be used as well.

The process according to the invention is correspondingly characterized in that in the forming region, at least one dewatering wire with zonally variable wire permeability is used.

According to an aspect of the present invention, a machine for producing a tissue web, having a forming region including at least one circulating, continuous dewatering wire, is provided. The machine includes at least one dewatering wire with zonally variable wire permeability within the forming region. According to another aspect of the present invention, at least one dewatering wire with zonally variable wire permeability is provided in the initial dewatering region.

In yet another aspect of the invention, a former is included having two circulating, continuous dewatering belts, which converge, forming a stock inlet nip. The belts are guided over a forming element, in particular such as a forming roll, and that as an outer belt that does not come into contact with the forming element and/or as an inner belt, a dewatering wire with zonally variable wire permeability is provided.

Additionally, other aspects of the present invention include a double wire former. In another aspect of the present invention, a crescent former is provided as the former, whose outer belt is formed by a dewatering wire with zonally variable wire permeability and whose inner belt is formed by a felt belt.

According to a further aspect of the present invention, at least one dewatering wire with zonally variable wire permeability is provided, which includes a woven material formed of warp and weft threads. In another aspect of the present invention, the zones of variable wire permeability of the dewatering belt are generated by the use of weaving threads of variable diameter and/or variable weaving pattern.

In another aspect of the present invention, a conditioning device, in particular such as a wire cleaning device, is assigned to the dewatering wire with zonally variable wire permeability. According to a still further aspect of the present invention, a process for producing a tissue web by a tissue machine having a forming region including at least one circulating, continuous dewatering wire, is provided wherein in the forming region, at least one dewatering wire with zonally variable wire permeability is used.

Further aspects of the invention include dewatering at a machine speed that is greater than approximately 1300 m/min, in particular greater than approximately 1500 m/min, and preferably greater than approximately 1800 m/min. According to other aspects of the present invention, at least one dewatering wire with zonally variable wire permeability is used in the initial dewatering region.

According to another aspect of the present invention, a former having two circulating, continuous dewatering belts is used. The belts converge, forming a stock inlet nip, and then are guided over a forming element, in particular a forming roll a dewatering wire with zonally variable wire permeability is provided as an outer belt that does not come into contact with the forming element and/or as an inner belt.

According to another aspect of the present invention, a double wire former is used. According to yet another aspect of the present invention, wherein as the former, a crescent former is used, whose outer belt is formed by a dewatering wire with zonally variable wire permeability and whose inner belt is formed by a felt belt.

Additionally, other aspects of the present invention include the use of at least one dewatering wire with zonally variable wire permeability, which has a woven material formed of warp and weft threads. In yet another aspect of the invention, at least one dewatering wire is used, whose zones of variable wire permeability are generated by the use of weaving threads of variable diameter and/or variable weaving pattern.

In another aspect of the present invention, the dewatering wire with zonally variable wire permeability is used in a region in which the dry content of the tissue web is less than approximately 20% and in particular less than approximately 12%, and preferably in the initial sheet forming region at a dry content less than approximately 6%.

According to an aspect of the invention, a machine for producing a tissue web is provided, including a forming with includes at least one circulating, continuous dewatering wire having zonally variable wire permeability. According to another aspect of the present invention, the at least one dewatering wire is provided in an initial dewatering region.

In yet another aspect of the invention, the forming element includes a forming roll. In another aspect of the present invention, the former includes a double wire former. According to a further aspect of the present invention, the former is a crescent former, wherein the outer belt is formed by the at least one dewatering wire with zonally variable wire permeability and wherein the inner belt is formed by a felt belt.

In another aspect of the present invention, the at least one dewatering wire includes a woven material formed of warp and weft threads. According to a still further aspect of the present invention zones of variable wire permeability of the at least one dewatering belt are formed by weaving threads at least one of a variable diameter and variable weaving pattern. Further aspects of the invention include a conditioning device assigned to the at least one dewatering wire. According to other aspects of the present invention, the conditioning device includes a wire cleaning device.

According to an aspect of the present invention, a process for producing a tissue web in a tissue machine is provided. The process includes forming the tissue web in a forming region of the tissue machine, wherein the forming region includes at least one circulating, continuous dewatering wire having zonally variable wire permeability.

According to another aspect of the present invention, the process includes performing dewatering at a machine speed that is greater than approximately 1300 m/min. In yet another aspect of the invention, the dewatering is performed at greater than approximately 1500 m/min. In another aspect of the present invention, the dewatering is performed at greater than approximately 1800 m/min.

In another aspect of the present invention, the process includes using the at least one dewatering wire in an initial dewatering region. According to still further aspects of the invention, the at least one dewatering wire is used in a region in which a dry content of the tissue web is less than approximately 20%. Further aspects of the invention, include the dry content of the tissue web being less than approximately 12%. Other aspects of the invention include wherein the at least one dewatering wire is used in an initial sheet forming region at a dry content less than approximately 6%.

As wires with zonally variable wire permeability, wires for instance of the type described in PCT/GB 99/02684 can be considered. Accordingly, the applicable wires can in particular comprise a woven material in which threads extending in a first direction, provided in one or more levels, are interwoven with threads extending in a second direction in such a way that the result is a grid that separates many systematically distributed regions of predeterminable configuration from one another and correspondingly defines them; the systematically distributed regions each include at least three threads extending in one direction and at least three threads extending in the other direction. The threads can in particular be weft threads and warp threads.

Further aspects of the present invention include the use of a former which includes a forming element and two circulating, continuous dewatering belts, at least one of which comprises the at least one dewatering wire with zonally variable wire permeability. The two circulating belts being arranged to converge to form a stock inlet nip, and then being guided over the forming element, as an outer belt, which does not come into contact with the forming element and as an inner belt, wherein at least one of the outer belt and the inner belt comprise the at least one dewatering wire with zonally variable wire permeability.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
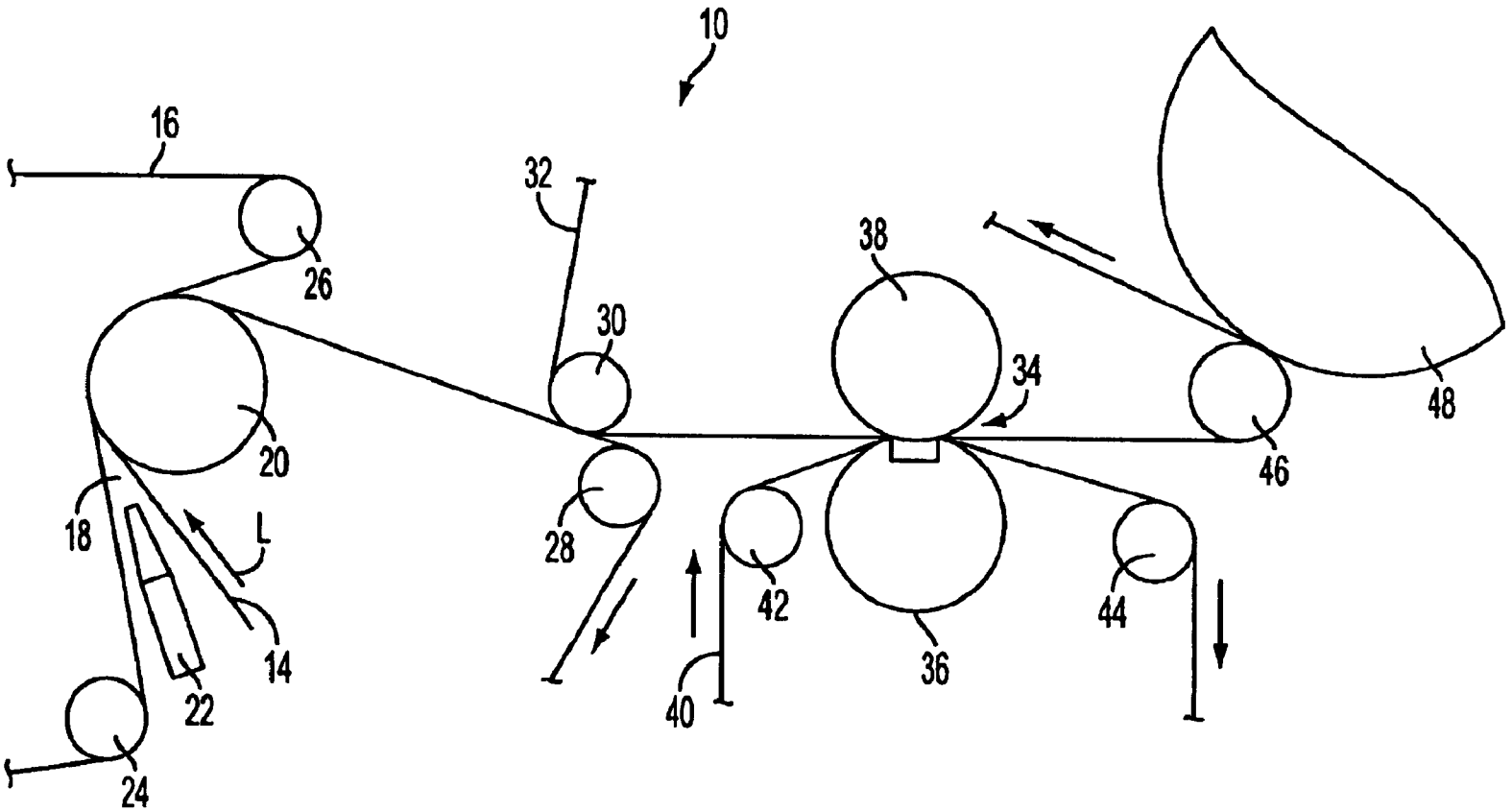
FIG. 1 is a schematic illustration of a double wire former in a machine for producing a tissue web, in which as an outer belt and/or as an inner belt, a dewatering wire with zonally variable wire permeability is provided.
Figure 2:
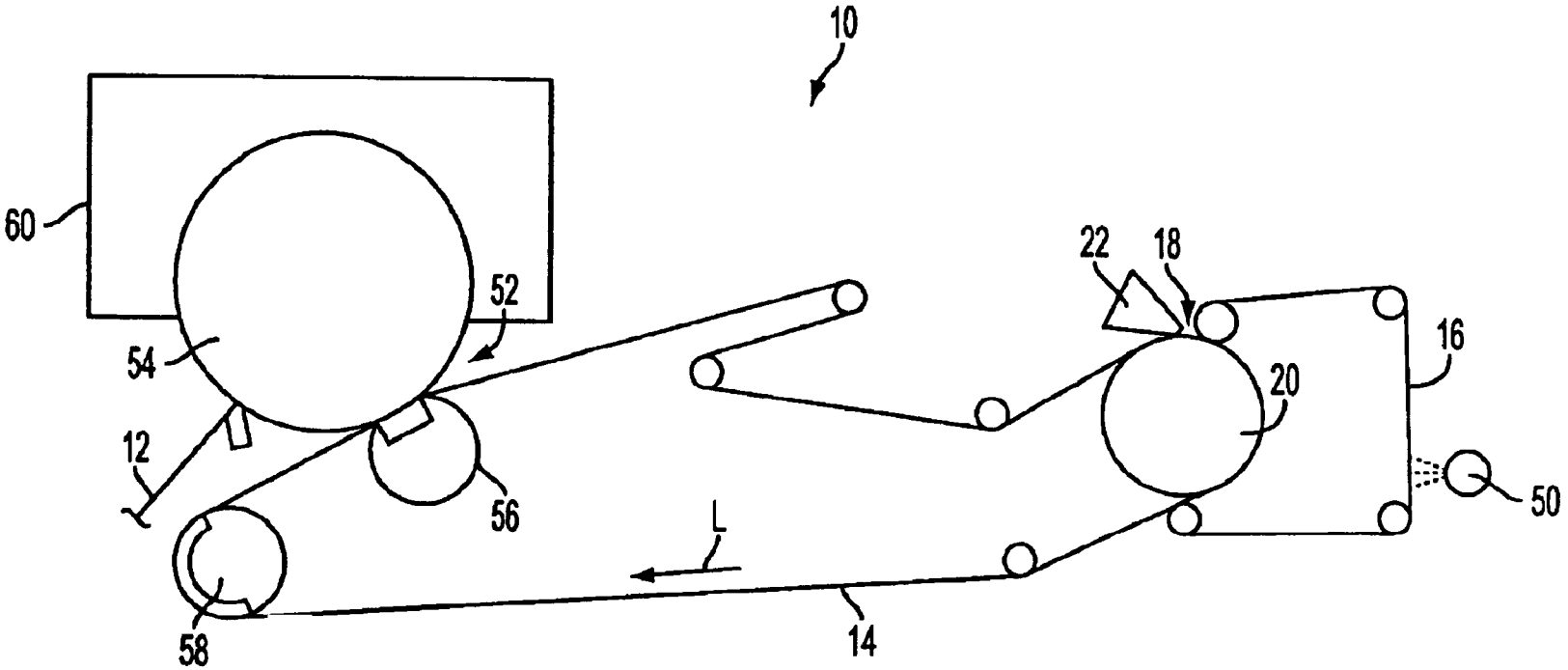
FIG. 2 schematically shows a crescent former, in which as an outer belt a dewatering wire with zonally variable wire permeability and as an inner belt a felt belt are provided.

The formers 10 shown in FIGS. 1 and 2 are each part of a machine for producing a tissue web 12. In the forming region, preferably in the initial dewatering region, at least one dewatering wire each, with zonally variable wire permeability, that is, a DSP screen is provided.

The two formers 10 each include two circulating, continuous dewatering belts 14, 16, which converge, forming a stock inlet nip 18, and are then guided over a forming element, embodied here by a forming roll 20. The fibrous material suspension is introduced into the stock inlet nip 18 by headbox 22.

FIG. 1 schematically shows a double wire former 10, in which one wire each is provided both as an inner belt 14 that comes into contact with the forming roll 20 and as an outer belt. At least one of the two dewatering wires 14, 16 is provided as a wire with zonally variable wire permeability, that is, as a DSP wire. Each DSP screen can be assigned a conditioning device, such as a wire cleaning device 50 in particular (see FIG. 2).

In the present case, the fibrous material suspension furnished by the headbox 22 is injected from diagonally below into the material inlet nip 18 formed between the two dewatering belts 14, 16. The outer belt 16, arriving from below, is guided over a deflection (guide) roll 24 past the headbox 22 to the forming roll 20 and from there is returned again via a further deflection roll (guide) 26.

The two dewatering belts 14, 16 are also separated from one another again in the region of the forming roll 20. The inner belt 14 is returned again via a deflection roll 28. Upstream of the deflection (guide) roll 28 in the belt travel direction L, the tissue web is accepted, in the region of a deflection (guide) roll 30, from the inner belt 14 by a watertight belt 32 and delivered to the press nip of a shoe press 34, which includes both a shoe press unit 36 located at the bottom and a mating roll 38 located at the top.

Besides the upper watertight belt 32 that carries the tissue web along with it, a bottom felt 40 is also passed through the press nip of the shoe press 34, and is guided both upstream and downstream of the shoe press 34 by a respective deflection (guide) roll 42 and 44. The bottom felt 40 is separated from the watertight belt 32 immediately downstream of the press nip of the shoe press 34, in order to avoid remoistening. The watertight belt 32, following the shoe press 34, is delivered together with the tissue web to a transfer roll 46, in the region of which the tissue web is transferred to a tissue cylinder or Yankee cylinder 48.

FIG. 2 schematically shows a crescent former 10, in which, as an outer belt 16 that does not come into contact with the forming roll 20, a dewatering wire with zonally variable wire permeability, that is, a so-called DSP wire, is provided. Here the inner belt 14 is formed by a felt belt. The DSP wire 16 can be assigned a conditioning device 50, in particular such as a wire cleaning device.

The tissue web 12 that is forming is delivered, following the forming roll 20, together with the inner belt 14 to a lengthened press nip 52, which is formed between a tissue drying cylinder or Yankee cylinder 54 and a shoe press unit, in this case a shoe press roll 56. Upstream in the belt travel direction L of the lengthened press nip 52, the inner belt 14 that guides the tissue web 12 is guided via a device provided with suction, in this case a suction roll 58. A drying hood 60 can be assigned to the Yankee cylinder 54.

The various dewatering wires with zonally variable wire permeability can for instance each comprise a woven material formed of warp and weft (filling) threads. The zones of variable wire permeability are generated by the use of weaving threads of variable diameter and/or variable weaving pattern.

As wires with zonally variable wire permeability, wires for instance of the type described in PCT/GB 99/02684 can be considered, and the disclosure of PCT/GB99/02684 is expressly incorporated by reference herein in its entirety. Accordingly, the applicable wires can in particular comprise a woven material in which threads extending in a first direction, provided in one or more levels, are interwoven with threads extending in a second direction in such a way that a grid results that separates many systematically distributed regions of predeterminable configuration from one another and correspondingly defines them; the systematically distributed regions each include at least three threads extending in one direction and at least three threads extending in the other direction. The threads can in particular be weft threads and warp threads.

Figure 3:
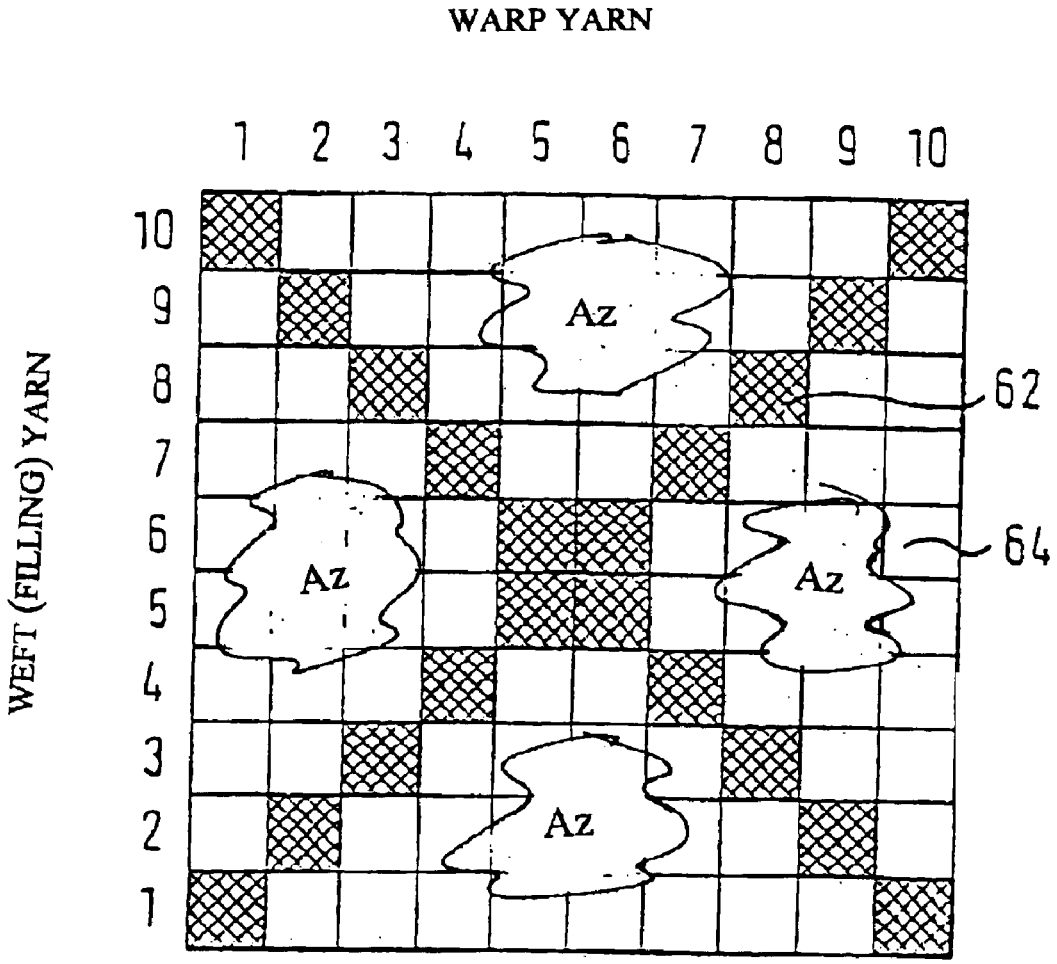
FIG. 3 is a weaving pattern diagram of a repeating portion of a dewatering wire, formed by a woven material, of zonally variable wire permeability.

FIG. 3 shows, purely by way of example, a weave pattern diagram of a repeating section of a possible embodiment of a dewatering wire with zonally varied wire permeability formed by such a fabric. In the present embodiment, the repeating weave pattern diagram includes ten warp yams and ten filling yarns. In the area of the hatched squares, the filling yam lies beneath the warp yam. In the area of the light squares, on the other hand, the filling yarn lies above the warp yarn. Depending on the circumstances of each case, the one or else the other side of the weave pattern diagram can lie outside. The hatched areas form a grid 62, by which a number of systematically distributed zones (areas) 64 of specified configuration are separated from one another and fixed accordingly.

As shown in FIG. 3, the dimensions of the zones are depicted as Az, which can represent areas of high permeability or areas of low permeability, however, it is not necessary that these dimensions are the same. In any event, Az represents the length and/or width of zones having a permeability different than that of the other zones.

Figure 4:
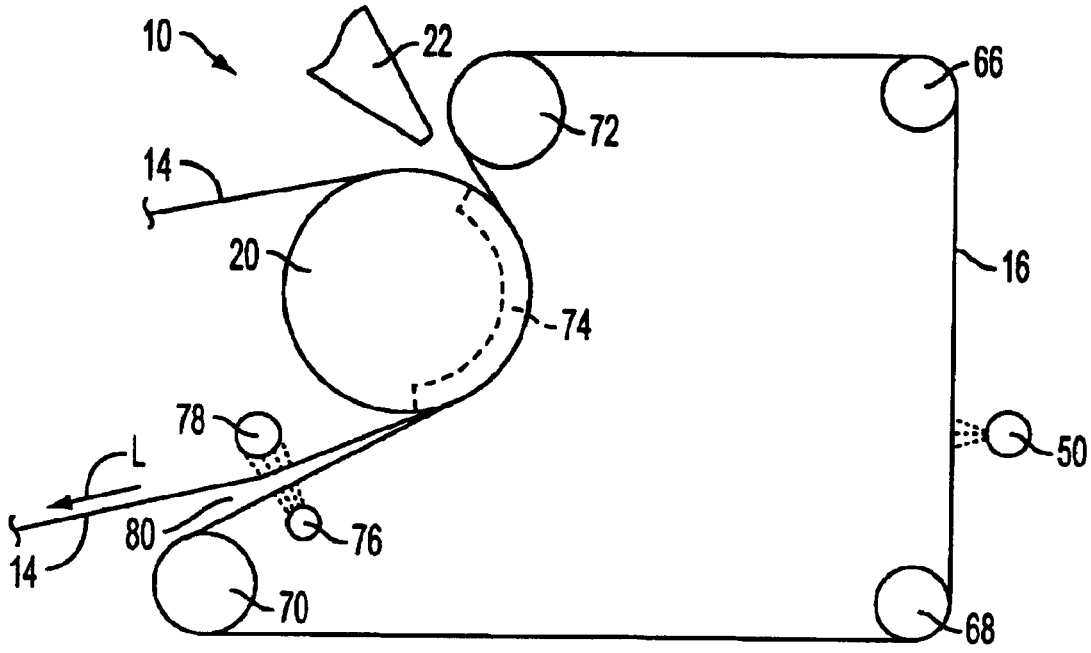
FIG. 4 shows an enlarged view of the forming zone depicted in FIG. 2, which includes a suction element inside the loop of the inner belt and a conditioning device assigned to the outer wire.

FIG. 4 illustrates an enlarged view of the forming zone of the former shown in FIG. 2, in which the essential details of the arrangement according to the invention are discernible. The former utilizes at least one suction element 78 which is positioned inside the loop of inner belt 14, in the area of separation point 80. Separation point 80 is a position where outer wire 16 and inner belt 14 are separated from each other. Alternatively or additionally, forming roll 20 can be provided with a suction zone 74. With such a suctioned forming roll 20, the fibrous web is pulled against inner belt 14 which can be a felt belt.

In the embodiment shown, suction element 78 is located, in the web travel direction L, in the area of separation point 80, e.g., in this case positioned in front of separation point 80. The vacuum present in suction element 78 can be adjustable. This can also be the case for the vacuum of suction zone 74. Moreover, each device may have its vacuum adjusted by an independent mechanism, e.g., such that each device is independently adjusted, or by a common mechanism which controls vacuum to both devices. Additionally, suction elements 78 or 74 can be embodied such that they affect inner belt 14 at least essentially over its entire width.

In the area of separation point 80, at least one blowing element 76 can also be provided inside the loop of outer wire 16. As a result, outer wire 16 can be impacted from the inside with a medium, for instance, such as blowing air. Blowing element 76 can be suitably embodied such that it affects outer wire 16 at least essentially over its entire width.

Outer wire 16 can be guided over suitably arranged guide rolls 66, 68, 70 and 72. Moreover, outer wire 16 may be arranged with a conditioning device 50 which can particularly be a wire cleaning device. Conditioning device 50 is suitably embodied such that it affects outer wire 16 at least essentially over its entire width. Conditioning device 50 may include a spray pipe, for instance, such as a "Duocleaner" made by the company Voith Sulzer, a roll having a scraper inserted into the corresponding dewatering wire, and/or the like.

In the exemplary embodiment depicted in FIG. 4, conditioning device 50 is positioned between guiding rolls 66 and 68. However, conditioning device 50 may also be positioned in the area of other guide rolls and, for instance, in the area adjacent guide roll 66.

Figure 5:
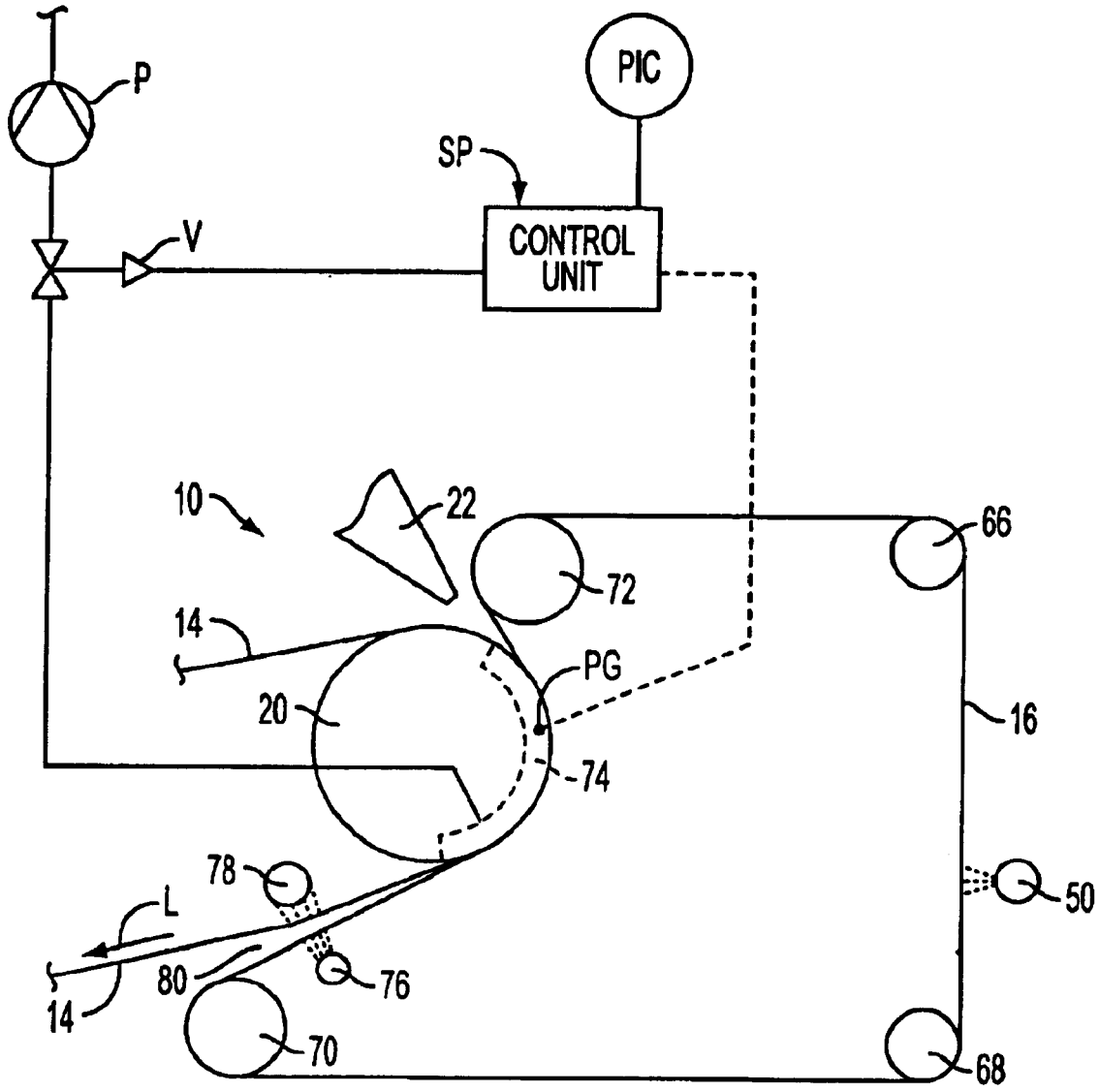
FIG. 5 shows an enlarged view of the forming zone depicted in FIG. 2, which includes an exemplary embodiment for regulating or controlling the vacuum to the suction zone.

FIG. 5 shows an enlarged view of the forming zone of the former depicted in FIG. 2 and illustrates an exemplary embodiment for regulating or controlling the vacuum to the suction zone. The former utilizes regulated, controlled and/or adjustable vacuum to suction zone 74 which is positioned inside the loop of inner belt 14, in the area of forming roll 20. A vacuum device P which may be a vacuum pump or an exhaust fan or similar vacuum source is connected to suction zone 74 to supply vacuum thereto. A valve V which may be a throttling device or a butterfly valve or the like is position in between the vacuum device P and the suction zone 74 in order to regulate the amount of vacuum which reaches the suction zone 74. A pressure gauge PG is positioned in the area of the suction zone 74 in order to measure a pressure in the suction zone 74. Each of the valve V and the pressure gauge PG is connected to a control unit. The control unit may utilize a set point SP and control instrumentation which functions as a pressure indicated and controlled PIC system.

In operation, valve V is set to achieve a certain vacuum in the suction zone 74. The desired vacuum may be achieved, e.g., when the dryness of the tissue web is higher than approximately 8% and preferably higher than approximately 12%. Additionally, it is preferred that the dryness be determined and/or measured after the suction zone 58 in the web travel direction L. The dryness may be measured by various dryness measuring devices such as a radioactive gauge or the like. The dashed line indicates an optional control circuit for the vacuum in the suction zone 74.

Figure 6:
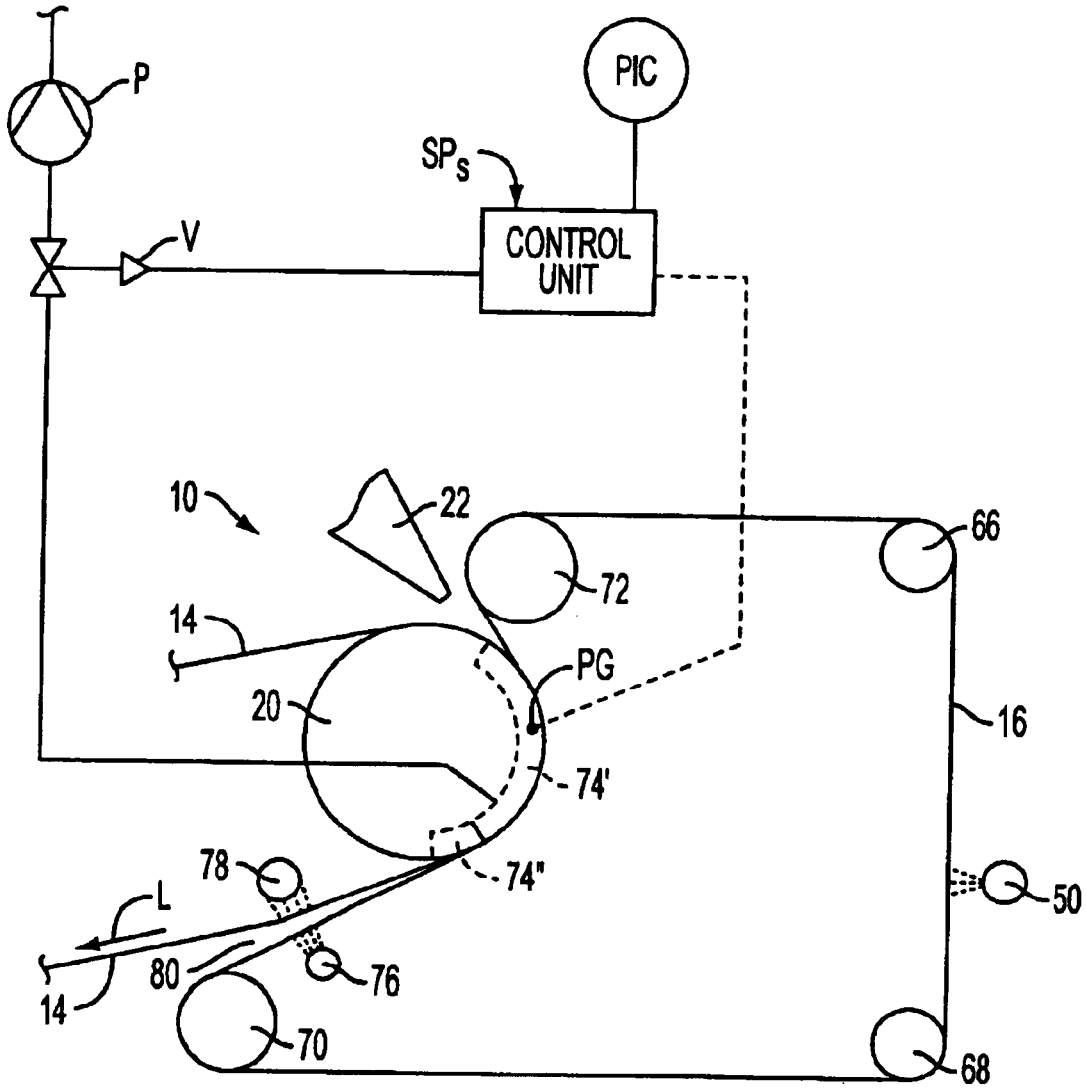
FIG. 6 shows an enlarged view of the forming zone depicted in FIG. 2, which includes a two zone suction zone and an exemplary embodiment for regulating or controlling the vacuum to a two zone suction zone.

FIG. 6 shows an enlarged view of the forming one of the former depicted in FIG. 2, which includes a two zone suction zone, and illustrates another exemplary embodiment for regulating or controlling the vacuum to a two zone suction zone. The former utilizes regulated, controlled and/or adjustable vacuum to a two zone suction zone 74' and 74" which is positioned inside the loop of inner belt 14, in the area of forming roll 20. Suction zone is divided into a first suction zone 74' and a second suction zone 74". A vacuum device P which may be a vacuum pump or an exhaust fan or similar vacuum source is connected to suction zone 74 to supply vacuum thereto. A valve V which may be a throttling device or a butterfly valve or the like is position in between the vacuum device P and the suction zone 74 in order to regulate the amount of vacuum which reaches the suction zone 74. A pressure gauge PG is positioned in the area of the suction zone 74 in order to measure a pressure in the suction zone 74. Each of the valve V and the pressure gauge PG is connected to a control unit. The control unit may utilize a set point $SP_s$ and control instrumentation which functions as a pressure indicated and controlled PIC system.

In operation, the vacuum in first suction zone 74' may be related and/or determined based upon the dewatering behavior of the web. In second suction zone 74", the vacuum may be related and/or determined based upon the separation behavior of the web from wire 16. In this regard, the stronger the web attaches to the wire 16 at separation 80, the higher the vacuum in zone 74" is adjusted to be in order to improve the ability of the web to detach from wire 16.

As in the embodiment of FIG. 5, valve V may be set to achieve a certain vacuum in each zone 74' and 74". The desired vacuum may be achieved, e.g., when the dryness of the tissue web is higher than approximately 8% and preferably higher than approximately 12%. Additionally, it is preferred that the dryness be determined and/or measured after suction zone 74' or suction zone 74" in the web travel direction L. The dryness may be measured by various dryness measuring devices such as a radioactive gage or the like. The system may also include devices for determining dewatering behavior of the web such as a camera. The dashed line indicates an optional control circuit for the vacuum in either or both suction zones 74' and 74".

Figure 7:
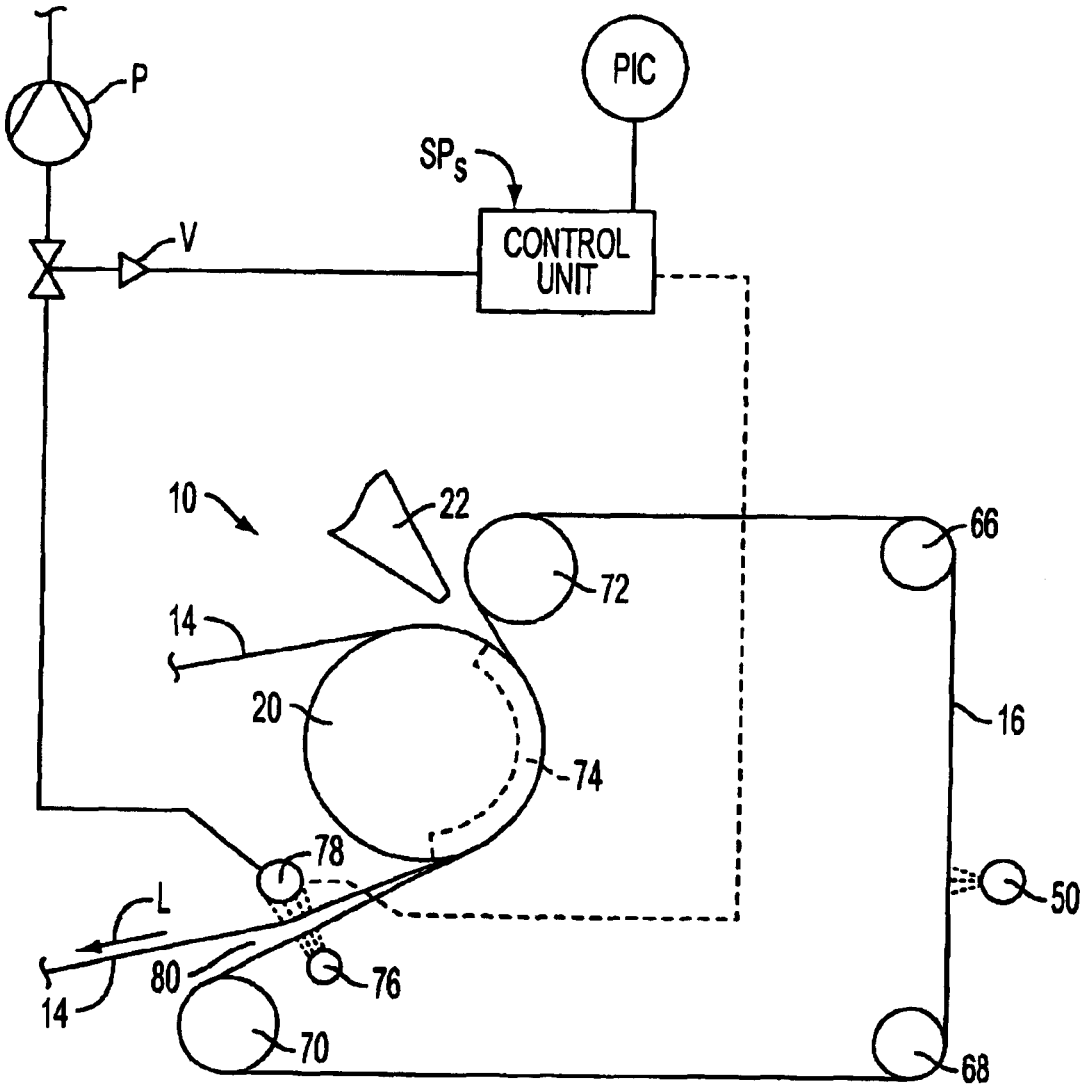
FIG. 7 shows an enlarged view of the forming zone depicted in FIG. 2, which includes another exemplary embodiment for regulating or controlling the vacuum to the suction device.

FIG. 7 shows an enlarged view of the forming zone of the former depicted in FIG. 2 and illustrates another exemplary embodiment for regulating or controlling the vacuum to the suction device. The former utilizes regulated, controlled and/or adjustable vacuum to suction device 78 which is positioned inside the loop of inner belt 14, in the area of separation point 80. A vacuum device P which may be a vacuum pump or an exhaust fan or similar vacuum source is connected to suction zone 74 to supply vacuum thereto. A valve V which may be a throttling device or a butterfly valve or the like is position in between the vacuum device P and the suction device 78 in order to regulate the amount of vacuum which reaches suction device 78. A pressure gauge PG is positioned in the area of suction device 78 and separation point 80 in order to measure a pressure at suction device 78. Each of the valve V and the pressure gauge PG is connected to a control unit. The control unit may utilize a set point $SP_s$ and control instrumentation which functions as a pressure indicated and controlled PIC system.

In operation, valve V is set to achieve a certain vacuum in suction device 78. The desired vacuum may be achieved, e.g., when the dryness of the tissue web is higher than approximately 8% and preferably higher than approximately 12%. Additionally, it is preferred that the dryness be determined and/or measured after the suction zone 74 in the web travel direction L. The dryness may be measured by various dryness measuring devices such as a radioactive gage or the like. Also, vacuum in suction device 78 may relate or be determined by the release behavior of the web from wire 16 as described above in FIG. 6.

Moreover, set point $SP_s$ may be set by hand or automatically depending on the release behavior. Accordingly, if the web or a portion of the web, e.g., the edges of the web, is not detached safely from wire 14, the vacuum in suction device 78 may be increased. Such a design allows the web to be separated more safely so that the sheet run is stabilized, e.g., so that the edges of the web do not flutter. Thus, the complete web is in stable contact with wire 14. As in the other embodiments, the dashed line indicates an optional control circuit for the vacuum in the suction device 78.

It should be noted that the vacuum control systems shown in FIGS. 5–7 may be combined into one complete system so that the vacuum in each of suction zone 74 and suction device 78 can be controlled and/or adjusted together. Various dryness measurement devices, separation detection devices, and other devices for determining dewatering behavior may also be included.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

List of Reference Characters

10 Former
12 Tissue web
14 Dewatering belt, inner belt
16 Dewatering belt, outer belt
18 Stock inlet nip
20 Forming roll
22 Headbox
24 Deflection roll
26 Deflection roll
28 Deflection roll
30 Deflection roll
32 Water tight belt
34 Shoe press
36 Shoe press unit
38 Mating roll
40 Bottom felt
42 Deflection roll
44 Deflection roll
46 Transfer roll
48 Tissue cylinder, Yankee cylinder
50 Conditioning device
52 Lengthened press nip
54 Tissue cylinder, Yankee cylinder
56 Shoe press roll
58 Suction roll
60 Drying hood
62 Grid
64 Region
66 Guiding roll
68 Guiding roll
70 Guiding roll
72 Guiding roll
74 Suction zone
76 Blowing element
78 Suction element
80 Separation point
L Belt travel direction

What is claimed is:

1. A machine for producing a tissue web, comprising:

a forming region with at least one circulating, continuous dewatering belt;

said forming region comprising a forming roll, wherein said at least one dewatering belt and another belt pass over the forming roll and separate from each other immediately following the forming roll;

said at least one dewatering belt comprising at least two zones having different wire permeabilities formed by warp and weft threads; and each at least two zones having at least one dimension of length and width less than 5 mm, wherein the tissue web is subjected to suction before said another belt and said at least one dewatering belt separate from each other immediately following the forming roll.

2. The machine according to claim 1, wherein said at least one dewatering belt comprises a dewatering wire and is provided in an initial dewatering region.

3. The machine according to claim 1, wherein the forming roll forms part of a former wherein said another belt comprises another circulating, continuous dewatering belt;

wherein said at least one dewatering belt and said another dewatering belt are arranged to converge to form a stock inlet nip, and wherein said at least one dewatering belt is an outer belt, which does not come into contact with said forming roll; and further comprising a suction device is arranged at a separation point, wherein the tissue web is transferred from said at least one dewatering belt to said another dewatering belt following the separation point.

4. The machine according to claim 3, wherein said former comprises a double wire former.

5. The machine according to claim 3, wherein said former comprises a crescent former, and wherein said another belt is a felt belt.

6. The machine according to claim 1, wherein said at least one dewatering belt comprises a woven material formed of warp and weft threads.

7. The machine according to claim 6, wherein said at least two zones of different wire permeabilities are formed by weaving threads of at least one of different diameter and different weaving pattern.

8. The machine according to claim 1, further comprising a conditioning device assigned to said at least one dewatering belt.

9. The machine according to claim 8, wherein said conditioning device comprises a wire cleaning device.

10. The machine according to claim 1, wherein said at least two zones having different wire permeabilities are structured to produce different dewatering speeds.

11. A process for producing a tissue web in a tissue machine, the process comprising:

forming the tissue web in a forming region of the tissue machine on at least one circulating, continuous dewatering belt comprising at least two zones having different wire permeabilities formed by warp and weft threads, wherein each at least two zones has at least one dimension of length and width of less than 5 mm, wherein said forming region comprises a forming roll, and wherein said at least one dewatering belt and another belt pass over the forming roll and separate from each other immediately following the forming roll; and suctioning the tissue web before said another belt and said at least one dewatering belt separate from each other immediately following the forming roll.

12. The process according to claim 11, further comprising performing dewatering at a machine speed that is greater than approximately 1300 m/min.

13. The process according to claim 12, wherein the dewatering is performed at greater than approximately 1500 m/min.

14. The process according to claim 13, wherein the dewatering is performed at greater than approximately 1800 m/min.

15. The process according to claim 11, further comprising using the at least one dewatering belt in an initial dewatering region.

16. The process according claim 11, wherein the forming roll forms part of a former, wherein said another belt and said at least one dewatering belt are arranged to converge to form a stock inlet nip, and wherein said at least one dewatering belt is an outer belt, which does not come into contact with the forming belt; and wherein the machine further comprises a suction device arranged at a separation point and wherein the method further comprises transferring the tissue web from said at least one dewatering belt to said another belt following the separation point.

17. The process according to claim 16, wherein the former comprises a double wire former.

18. The process according to claim 16, wherein the former comprises a crescent former, and wherein said another belt is a felt belt.

19. The process according to claim 11, wherein said at least one dewatering belt comprises a woven material formed of warp and weft threads.

20. The process according to claim 11, wherein the at least two zones of different wire permeabilities are formed by weaving threads comprising at least one of different diameter and different weaving pattern.

21. The process according to claim 11, wherein said at least one dewatering belt comprises a wire and is used in a region in which a dry content of the tissue web is less than approximately 20%.

22. The process according to claim 21, wherein the dry content of the tissue web is less than approximately 12%.

23. The process according to claim 11, wherein said at least one dewatering belt is used in an initial sheet forming region at a dry content less than approximately 6%.

24. The process according to claim 11, wherein dewatering speeds in the at least two zones are different.

25. A machine for producing a tissue web, comprising:

a forming region comprising a forming roll;

a dewatering belt and another belt passing over the forming roll;

the dewatering belt and the another belt separating from each other immediately following the forming roll;

the dewatering belt comprising at least two zones having different wire permeabilities formed by warp and weft threads;

each at least two zones having at least one dimension of length and width less than 5 mm; and at least one suction zone arranged before the dewatering belt and the another belt separate from each other, wherein the tissue web is subjected to suction while being guided over the forming roll and before the another belt and the dewatering belt separate from each other.

26. The machine according to claim 25, wherein the tissue web is guided on the another belt following a separation point which immediately follows the forming roll.

27. The machine according to claim 25, wherein the tissue web is dewatered machine speed that is greater than approximately 1300 m/min.

28. The machine according to claim 25, wherein the forming roll is arranged former which comprises one of a double wire former and a crescent former.

29. The machine according to claim 25, wherein the dewatering belt comprises a watering wire.

30. A process for producing a tissue web in the machine of claim 25, the process comprising:

forming the tissue web in the forming region;

suctioning the tissue web with the at least one suction zone while the tissue web is guided by the forming roll between the dewatering belt and the another belt; and separating from each other the another belt and the dewatering belt immediately wing the forming roll.

* * * * *